US008622721B2

(12) United States Patent
Fukasaku et al.

(10) Patent No.: US 8,622,721 B2
(45) Date of Patent: Jan. 7, 2014

(54) MOTOR DRIVEN COMPRESSOR

(75) Inventors: Hiroshi Fukasaku, Aichi-ken (JP); Atsushi Saito, Aichi-ken (JP); Masato Takamatsu, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 179 days.

(21) Appl. No.: 13/073,120

(22) Filed: Mar. 28, 2011

(65) Prior Publication Data

US 2011/0236234 A1 Sep. 29, 2011

(30) Foreign Application Priority Data

Mar. 29, 2010 (JP) ..... 2010-075391
Aug. 31, 2010 (JP) ..... 2010-194503

(51) Int. Cl.
*F04D 33/00* (2006.01)

(52) U.S. Cl.
USPC ..... 417/410.5; 417/410.3; 417/423.7; 417/423.14; 417/410.1; 310/56; 310/156.53; 310/156.56

(58) Field of Classification Search
USPC ..... 417/410.1, 423.1, 423.7, 423.9, 423.14, 417/410.5, 410.3; 418/55.1; 310/56, 310/156.53, 156.56
See application file for complete search history.

(56) References Cited

U.S. PATENT DOCUMENTS 3,209,992 A * 10/1965 Christiansen ..... 417/410.1
3,373,485 A * 3/1968 Nelsen ..... 29/598
6,126,386 A * 10/2000 Kohyama et al. ..... 415/55.1
2007/0126304 A1* 6/2007 Ito et al. ..... 310/156.53
2008/0008409 A1* 1/2008 Hong et al. ..... 384/130
2008/0160888 A1* 7/2008 Hutchins ..... 451/359
2010/0170273 A1* 7/2010 Morimoto et al. ..... 62/176.6

FOREIGN PATENT DOCUMENTS

JP 2002-125341 A 4/2002
JP 2007-315663 A 12/2007
JP 2009-222034 A 10/2009
JP 2009-225636 A 10/2009
WO 2009/037759 A1 3/2009
WO WO 2009/047095 * 4/2009
WO WO 2009/116282 * 9/2009

OTHER PUBLICATIONS

Translation of WO 2009116282.*
Machine Translation of WO 2009047095.*
Chinese Office Action dated May 6, 2013 issued in Chinese Patent Application No. 201110078477.8.

* cited by examiner

*Primary Examiner* — Charles Freay
*Assistant Examiner* — Christopher Bobish
(74) *Attorney, Agent, or Firm* — Sughrue Mion, PLLC

(57) ABSTRACT

A motor-driven compressor includes a housing, a rotary shaft, a compression mechanism and an electric motor. The housing includes a suction port and a discharge port. The compression mechanism is disposed in the housing and compresses refrigerant flowed through the suction port into the compression mechanism and discharges the refrigerant through the discharge port. The electric motor is disposed in the housing and drives the rotary shaft to rotate to drive the compression mechanism. The electric motor includes a rotor fixedly mounted on the rotary shaft and a stator fixed to the housing. The rotor includes a permanent magnet and a compressor interior environment improvement agent containing at least one of an absorbent for absorbing moisture and a neutralizer for neutralizing acid.

18 Claims, 19 Drawing Sheets

MOTOR DRIVEN COMPRESSOR

BACKGROUND OF THE INVENTION

The present invention relates to a motor-driven compressor.

As one of the global warming prevention measures, in the refrigerant circuit of a vehicle air-conditioner, new type refrigerant having little effect on ozone depletion has been replacing conventional refrigerant such as chlorofluorocarbon. A refrigerant whose molecular formula is $C_3H_mF_n$ (wherein "m" is an integer from one to five, "n" is an integer from one to five, and an equation of "m+n=6" is satisfied) and which has one double bond, such as $CF_3—CF=CH_2$ (2,3,3,3-tetrafluoro-1-propene) as disclosed in Japanese Patent Application Publication No. 2009-225636, has recently been attracting the attention of the industry as a new type refrigerant (hereinafter referred to as "HFO1234yf type refrigerant").

HFO1234yf type refrigerant which has the double bond tends to be decomposed in the presence of moisture. If moisture enters into the refrigerant circuit for some reason during manufacturing or use of a vehicle air-conditioner having HFO1234yf type refrigerant, the refrigerant is decomposed and, accordingly, hydrogen fluoride (HF) is produced from fluorine (F) in the refrigerant. Acid such as HF causes early corrosion to metal parts of the motor-driven compressor having relatively low corrosion resistance. Additionally, moisture per se causes chemical reaction to occur in the metal parts of the motor-driven compressor thereby to degrade their characteristics.

One of the parts incorporated in an electric motor of the motor-driven compressor that has the lowest corrosion resistance is a permanent magnet. Ferrite magnet and rare earth magnet are mainly used in the electric motor, but they tend to degrade their characteristics in the presence of acid or moisture. Rare earth magnet is more susceptible to acid or moisture than ferrite magnet. Any degraded characteristics of the permanent magnet of the electric motor deteriorates the performance of the motor-driven compressor.

The same problem may occur in conventional refrigerant, any new type refrigerant to be developed in future and lubricating oil contained in refrigerant in the motor-driven compressor, as well as HFO1234yf type refrigerant. Additionally, chemical reaction of moisture with any parts of the motor-driven compressor such as permanent magnet may invite the same problem with the motor-driven compressor.

The present invention is directed to providing a motor-driven compressor which can prevent characteristics degradation of a permanent magnet incorporated in an electric motor.

SUMMARY OF THE INVENTION

In accordance with the present invention, a motor-driven compressor includes a housing, a rotary shaft, a compression mechanism and an electric motor. The housing includes a suction port and a discharge port. The compression mechanism is disposed in the housing and compresses refrigerant flowed through the suction port into the compression mechanism and discharges the refrigerant through the discharge port. The electric motor is disposed in the housing and drives the rotary shaft to rotate to drive the compression mechanism. The electric motor includes a rotor fixedly mounted on the rotary shaft and a stator fixed to the housing. The rotor includes a permanent magnet and a compressor interior environment improvement agent containing at least one of an absorbent for absorbing moisture and a neutralizer for neutralizing acid.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

is

DETAILED DESCRIPTION OF THE PREFERRED EMBODIMENTS

Figure 1:
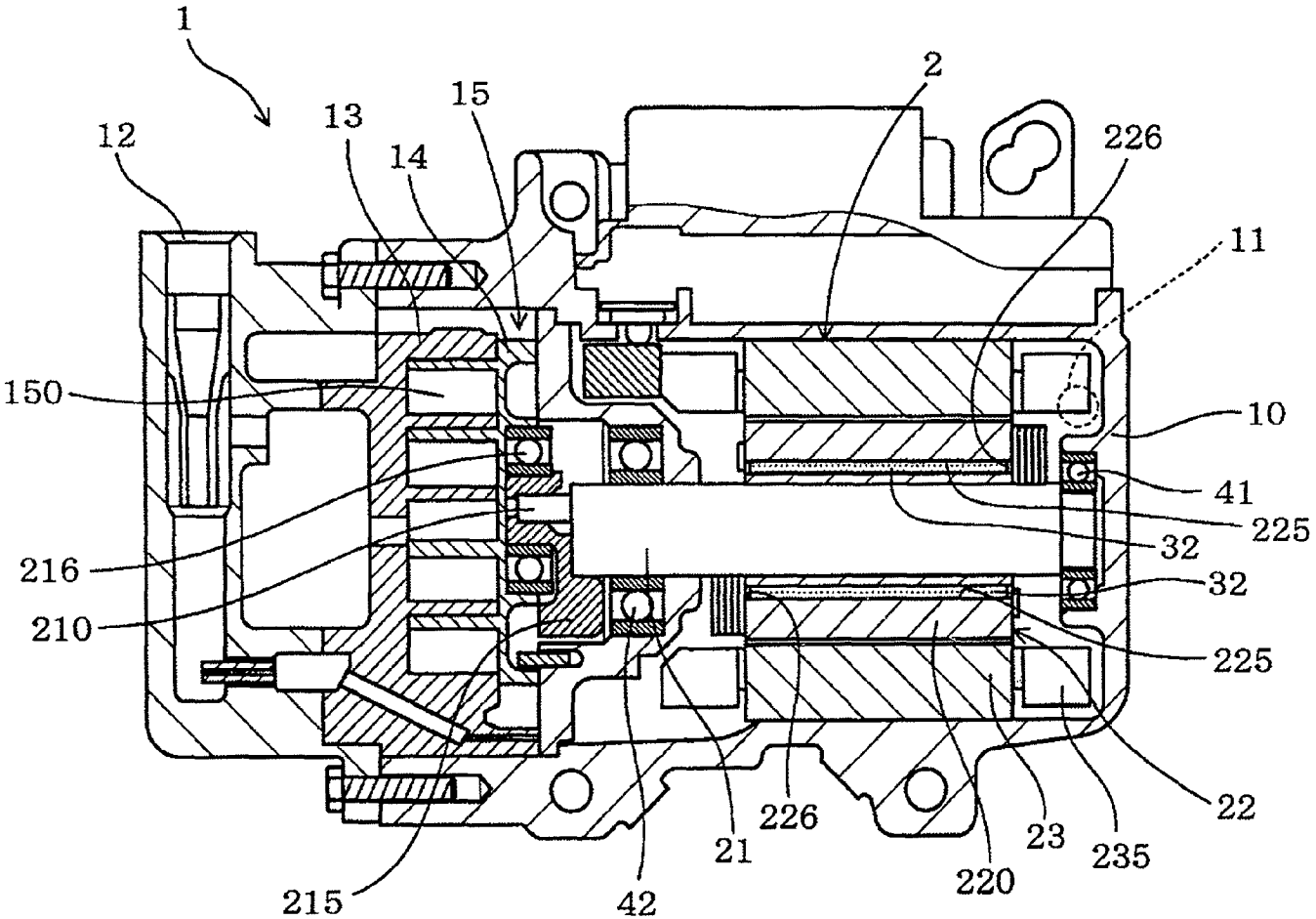
FIG. 1 is a longitudinal sectional view of a motor-driven compressor according to a first preferred embodiment of the present invention.

A motor-driven compressor according to the present invention has a structure including at least one of an adsorbent for absorbing moisture or a neutralizer for neutralizing acid as a compressor interior environment improvement agent. The motor-driven compressor may have a structure including both or only one of the above absorbent and/or neutralizer. The structure of the motor-driven compressor may be determined by the size of an agent hole for the compressor interior environment improvement agent, or whether or not refrigerant or lubricating oil in the motor-driven compressor tends to produce acid.

The rotor includes a magnet hole formed to extend therethrough along the axial direction thereof, and a permanent magnet is disposed in the magnet hole. The rotor also includes an agent hole formed to extend therethrough along the axial direction thereof, and a compressor interior environment improvement agent is disposed in the agent hole. The magnet and agent holes may be formed in the rotor so as to extend along the axial direction thereof and open at one axial end thereof.

The rotor includes a rotor core including the magnet and agent holes and a pair of end plates disposed on the opposite ends of the rotor core. The each end plate has a fluid hole for communication between the agent hole and outside of the rotor core. In this structure, the rotor includes the rotor core and a pair of the end plates, and the rotor core is interposed between the end plates. The end plates close the opposite ends of the magnet hole, so that circulating refrigerant and lubricating oil are prevented from flowing directly into the magnet hole. This reduces the fear of contact between the permanent magnet and the moisture or acid contained in the circulating refrigerant and lubricating oil. The fluid holes formed in the end plate of the rotor core allow the circulating refrigerant and lubricating oil to be positively introduced through the fluid holes into the agent holes. Rotating the rotor enhances the chance of contact between the compressor interior environment improvement agent and the fluid such as refrigerant flowing through the fluid hole into the agent hole. Thus, moisture or acid in the rotor is removed or neutralized early by the compressor interior environmental improvement agent disposed in the agent hole, so that the circulating refrigerant and lubricating oil entering into the magnet hole exists without chemical reaction with the permanent magnet.

A fin is disposed in the fluid hole for introducing fluid into the agent hole when the rotor rotates. A plate portion of the fin may be disposed to face the fluid hole of the end plate and be inclined with respect to the end plate.

A space is formed extending axially in the agent hole adjacent to the compressor interior environment improvement agent or in the compressor interior environment improvement agent adjacent to the agent hole. More specifically, a longitudinal groove serving as the space is formed to extend axially in at least one of the inner surface of the agent hole and the outer surface of the agent unit including the compressor interior environment improvement agent. Fluid passage is formed by the above space, thereby further enhancing the chance of contact between the agent unit and the refrigerant and lubricating oil.

The rotor includes a rotor core including the magnet and agent holes and a pair of end plates disposed on the opposite ends of the rotor core. Each end plate closes the agent hole and the magnet hole so as to seal the agent hole and the magnet hole. A communication passage is formed in the rotor core or the inner surface of the end plate for communication between the magnet hole and agent hole. In this structure, refrigerant is prevented from entering into the agent and magnet holes, and any moisture or acid contained in the refrigerant entering into the agent and magnet holes is absorbed or neutralized early by the compressor environment improvement agents. Moisture or acid entering into the magnet hole is introduced into the agent hole through the communication passage, so that the moisture or acid in the magnet hole may be prevented from staying therein, with the result that characteristic degradation of the permanent magnet may be delayed.

In this type of rotor where the end plates close the agent and magnet holes of the rotor core so as to seal the agent and magnet holes, the outer surface of the rotor is covered with a resin coating. Moisture or acid may be prevented by the resin coating from entering into the magnetic hole. If moisture or acid enters into the magnet hole even though the resin coating is applied to the rotor, moisture or acid may be removed or neutralized early by the compressor environmental improvement agent. The resin coating may be applied to the rotor by means of spraying, dipping or electrodeposition coating. The rotor is mounted on the rotary shaft, and the rotor and the boundary between the rotor and the rotary shaft are covered with the resin coating. Thus, moisture and acid may be prevented from entering into the rotor through the boundary.

The resin for the resin coating includes natural resin, synthetic resin, natural rubber and synthetic rubber. Additionally, a polyethylene series resin, epoxy series resin, a fluorine series resin, an acrylic series resin, a polyamide series resin, a polyamide-imide series resin, a silicone series resin, a polyether ether ketone series resin, a polyetherimide series resin, a phenol series resin, a melamine series resin, a urethane series resin or a rubber is used as the resin for the resin coating.

The agent hole of the rotor may be located at any position where the electric motor has little effect on the magnetic circuit characteristics. For activating the compressor environmental improvement agent disposed in the agent hole as much as possible, the agent hole is preferably formed in the rotor at a position adjacent to the permanent magnet. Thus, the rotor is disposed inside the stator, and the agent hole is formed inside the permanent magnet. In this type of rotor which is disposed inside the stator, the agent hole is located at the above position, so that the magnetic characteristics of the rotor is maintained and the installation space for the compressor environmental improvement agent is easily obtained. The permanent magnets may be disposed in the rotor disposed in the rotor in a polygonal or circular arrangement as seen in the axial direction of the rotor. The permanent magnet may be formed to have a plate shape or a shape of a circular arc in cross-section thereof.

The rotor is disposed outside the stator, and the agent hole is formed outside the permanent magnet. In the structure where the rotor is disposed outside of the stator, the magnetic characteristics of the rotor is maintained, and the installation space for the compressor environmental improvement agent may be easily obtained. In the structure where the stator is disposed inside the rotor, the agent hole is formed in the stator and the compressor environment improvement agent is disposed in the agent hole. The permanent magnets may be disposed in the rotor in a polygonal or circular arrangement as seen in the axial direction of the rotor. The permanent magnet may be formed to have a plate shape or a shape of a circular arc in cross-section thereof.

The absorbent is made of at least one of zeolite, activated carbon, alumina and silica gel. The absorbent has an excellent adsorption performance per unit volume, and is useful for installing in the limited space inside the rotor. The absorbent is generally called as a desiccant.

The neutralizer is made of at least one of calcium hydroxide, magnesium hydroxide, calcium carbonate and sodium carbonate. These substances are preferable since the substances stably exist in the solid state for a long period of time.

The rotor may include the grained absorbent and neutralizer inserted in the agent hole closed at the opposite ends thereof by covers having a mesh structure or the above end plates. An agent unit including a case whose each end has a mesh structure and which is filled with at least one of absorbent and neutralizer is inserted in the agent hole. The absorbent formed into a shape corresponding to the shape of the agent hole is used as the absorbent.

The motor-driven compressor is a vehicle air-conditioner including a circulation path made of a nonmetal tube. The vehicle air-conditioner includes the motor-driven compressor, a condenser, a receiver, an expansion valve and an evaporator which are connected through a circulation path filled with refrigerant and lubricating oil. Part of the circulation path is made of a nonmetal tube such as resin tube for having flexible characteristics. The resin of the resin tube includes natural resin, synthetic resin, natural rubber and synthetic rubber. The nonmetal tube has characteristics allowing little moisture to pass therethrough. Thus, if the nonmetal tube is used under hot and humid environment for a long period of time, moisture content in air enters into the circulation path through the nonmetal tube such as resin tube. In the refrigeration cycle having the vehicle air-conditioner including the circulation path made of the nonmetal tube such as resin tube, refrigerant tends to be decomposed to produce acid as compared to in another refrigeration cycle having the circulation path with no nonmetal tube. Thus, the structure where the compressor environment improvement agent is disposed inside the rotor of the electric motor is useful for the vehicle air-conditioner including the circulation path made of the nonmetal tube.

The motor-driven compressor is used in a refrigeration cycle in that refrigerant or mixed refrigerant circulates, the molecular formula of the refrigerant is $C_3H_mF_n$ in that "m" is an integer from one to five, "n" is an integer from one to five and an equation of "m+n=6" is satisfied and that has one double bond. The HFO1234yf type refrigerant is decomposed to produce hydrogen fluoride in the presence of moisture. Thus, the structure where the compressor environment improvement agent is disposed inside the rotor of the electric motor is useful for delaying production of acid.

In the motor-driven compressor, the housing is filled with at least one of polyol ester (POE), polyvinyl ether (PVE) and polyalkylene glycol (PAG) as lubricating oil. In this structure, it is not preferable that moisture enters into the circulation path. For example, polyol ester is hydrolyzed into organic carboxylate in the presence of moisture. Organic carboxylate causes early corrosion to the permanent magnet as in the case of hydrogen fluoride. In this case, the structure where the compressor environment improvement agent is disposed inside the rotor of the electric motor is effective for delaying production of acid.

The following will describe a motor-driven compressor according to a first preferred embodiment of the present invention with reference to FIGS. 1 through 4. Referring to FIG. 1, the motor-driven compressor designated by reference numeral 1 includes a housing 10 having a compression mechanism 15 and an electric motor 2. A suction port 11 and a discharge port 12 are formed in the housing 10. Refrigerant is flowed through the suction port 11 into the compression mechanism 15, and the refrigerant is compressed in the compression mechanism 15. The compressed refrigerant is discharged out of the compression mechanism 15 and the motor-driven compressor through the discharge port 12. The electric motor 2 drives a rotary shaft 21 to rotate thereby to drive the compression mechanism 15.

The compression mechanism 15 has a fixed scroll 13 fixed to the housing 10 and a movable scroll 14 disposed in the housing 10 so as to make an orbital motion in facing the fixed scroll 13. A variable compression chamber 150 is formed between the fixed scroll 13 and the movable scroll 14 for compressing refrigerant. The movable scroll 14 is connected to a crank pin 210 through a bearing 216 and a crank bush 215 such that the movable scroll 14 makes the above orbital motion with the rotation of the rotary shaft 21 for varying the volume of the compression chamber 150 between the fixed scroll 13 and the movable scroll 14.

Figure 2:
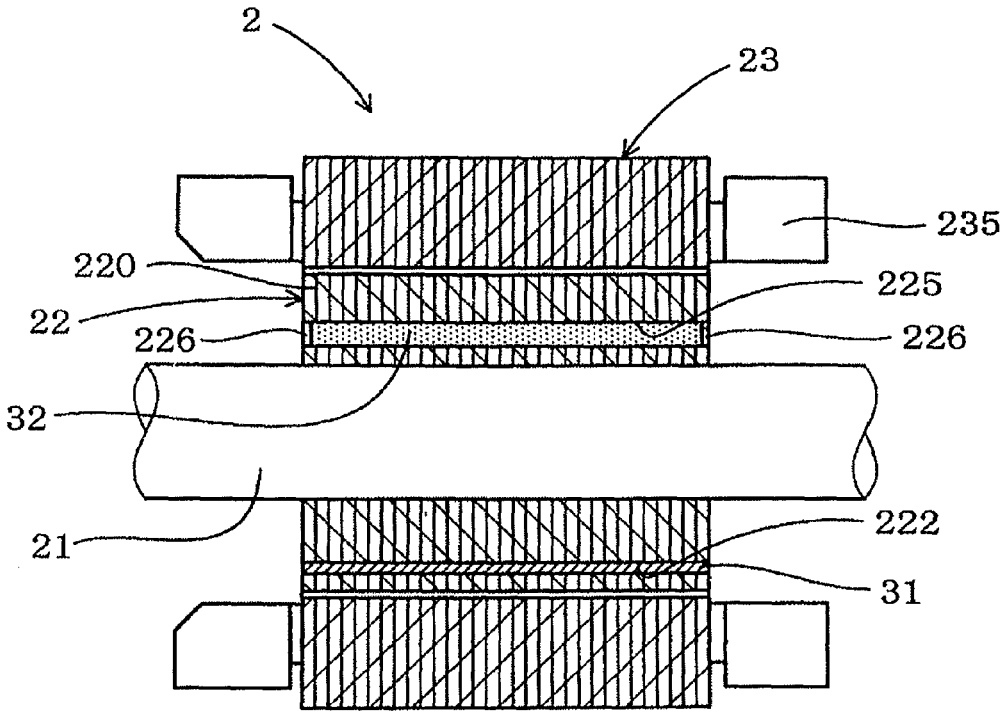
FIG. 2 is a schematic view showing an electric motor of the motor-driven compressor of FIG. 1.

The rotary shaft 21 is inserted in a center hole 221 formed through a rotor 22 of the electric motor 2 with the opposite ends of the rotary shaft 21 extending out of the center hole 221 and rotatably supported by the housing 10 through bearings 41, 42, respectively. As shown in FIGS. 1, 2, the electric motor 2 includes the rotor 22 and a stator 23. The rotor 22 is fixedly mounted on the rotary shaft 21, and the stator 23 is fixed to the inner peripheral surface of the housing 10 outside the rotor 22. A coil 235 is disposed in the stator 23. The rotor 22 having the permanent magnet 31 is rotated by energizing the coil 235.

Figure 3:
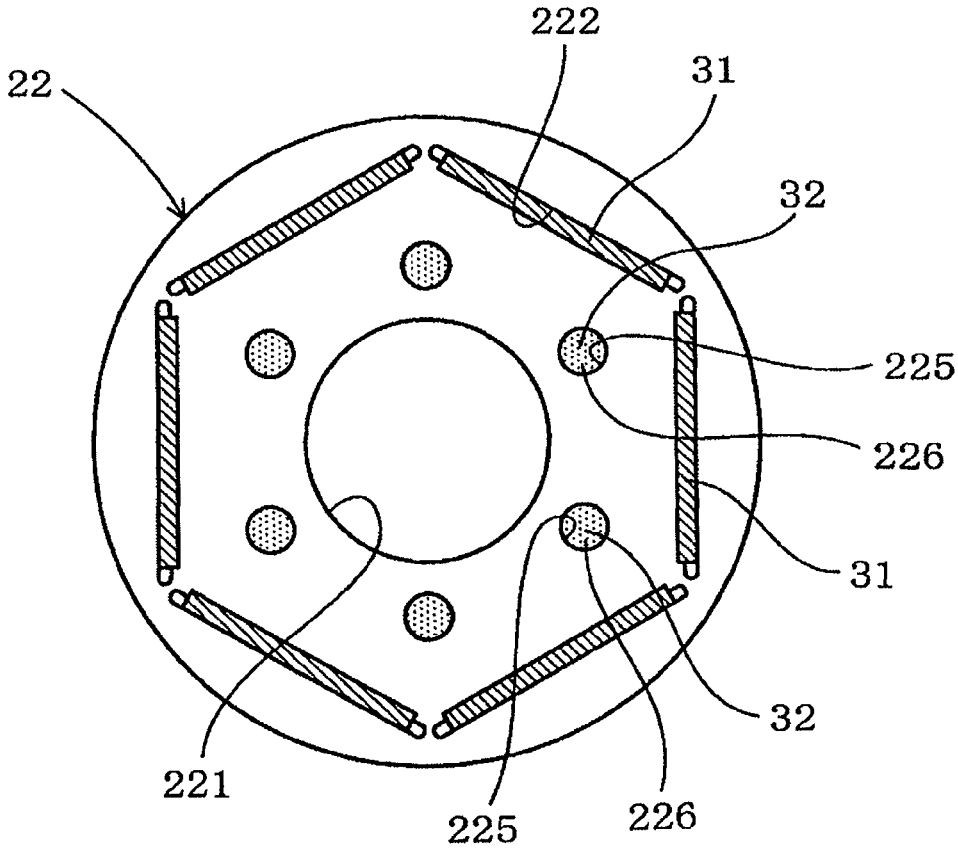
FIG. 3 is a schematic cross-sectional axial view showing a rotor of the electric motor of FIG. 2.

As shown in FIGS. 1 through 3, the rotor 22 includes a cylindrical rotor core 220 formed of a plurality of laminated electromagnetic steel sheets and has six magnet holes 222 formed therethrough and extending axially of the rotor 22. The six magnet holes 222 are formed into a shape corresponding to the shape of the permanent magnet 31 and disposed in a hexagonal arrangement as seen in the axial direction of the rotor 22. The permanent magnet is formed of known neodymium magnet (rare earth magnet) which is composed mainly of neodymium (Nd), iron (Fe) and boron (B).

As shown in FIGS. 2, 3, the rotor 22 has an absorbent such as zeolite as the compressor interior environment improvement agent 32. The compressor interior environment improvement agent 32 is disposed in each of a plurality of agent holes 225 formed through the rotor core 220 along the axial direction thereof. Covers 226 having a mesh structure are disposed at the opposite ends of each agent hole 225. The agent hole 225 between the covers 226 is filled with zeolite as the absorbent. Average particle diameter of zeolite is between 0.5 and 10 mm. The mesh structure of the cover 226 is formed to have openings with a size smaller than the diameters of zeolite particles for preventing zeolite from flowing out of the agent hole 225. In addition, the rotor core 220 has fixing rivets (not shown) and holes (not shown either) through which the rivets are inserted.

Figure 4:
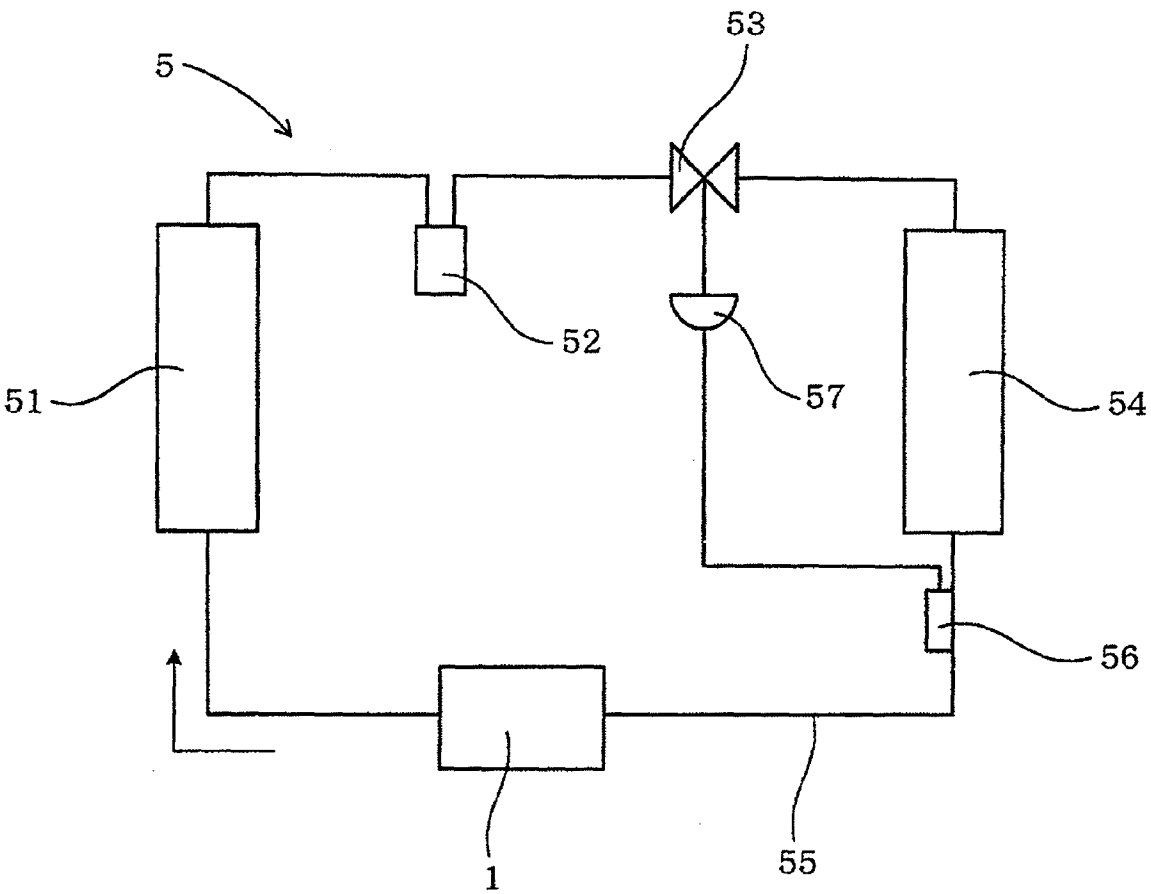
FIG. 4 is a schematic configurational view of a vehicle air-conditioner including the motor-driven compressor of FIG. 1.

As shown in FIG. 4, the above-described motor-driven compressor 1 is used as a compressor for a vehicle air-conditioner 5. The vehicle air-conditioner 5 includes the motor-driven compressor 1, a condenser 51, a receiver 52, an expansion valve 53 and an evaporator 54 which are connected through a circulation path 55 in this order from the motor-driven compressor 1 on the side of its discharge port 12. The opening of the expansion valve 53 is adjusted by a controller 57 in accordance with the temperature of refrigerant measured by a temperature sensor 56 disposed downstream of the evaporator 54.

The receiver 52 functions to separate liquid refrigerant from gas refrigerant and to allow only liquid refrigerant to flow to the expansion valve 53, and to remove moisture contained in refrigerant by absorbent disposed therein (not shown). The circulation path 55, or the motor-driven compressor 1, is filled with $CF_3$—CF═$CH_2$ (2,3,3,3-tetrafluoro-1-propene) as refrigerant and polyol ester as lubricating oil (lubricant). Part of the circulation path 55 is made of a non-metal tube such as resin tube.

If the above-described vehicle air-conditioner 5 is driven for a long period of time, moisture passes or permeates through the resin tube and gradually enters into the circulation path 55. If the moisture in the circulation path 55 is not removed, but continues to exist in the circulation path 55, refrigerant is decomposed thereby to produce HF. The permanent magnet is degraded by chemical reaction with the moisture itself. According to a conventional vehicle air-conditioner such as 5, moisture entering into the circulation path 55 is removed only by the absorbent incorporated in the receiver such as 52.

According to the vehicle air-conditioner 5 of the first preferred embodiment of the present invention, the compressor interior environment improvement agent (absorbent) 32 is provided in the rotor 22 of the motor-driven compressor 1 in addition to the absorbent in the receiver 52. The provision of the absorbent 32 in the motor-driven compressor 1 increases the permissible volume of moisture entering into the vehicle air-conditioner 5 of the refrigeration cycle without increasing the installation space for the vehicle air-conditioner 5 as the refrigeration cycle.

Therefore, if the vehicle air-conditioner 5 is used in a hot and humid region for a long period of time, increased total moisture absorbing performance by the additional absorbent in the motor-driven compressor 1, as well as the absorbent in the receiver permits the vehicle air-conditioner 5 to operate stably for an extended period of time. Though the permanent magnet 31 in the rotor 22 tends to degrade its characteristics in the presence of acid or moisture in comparison with the other members or parts of the motor-driven compressor 1, the compressor interior environment improvement agent (absorbent) 32 disposed just adjacent to the permanent magnet 31 removes any moisture entering close to the permanent magnet 31, thus preventing characteristic degradation of the permanent magnet 31. Though in the first preferred embodiment of the present invention only absorbent is used as the compressor interior environment improvement agent 32, neutralizer may be additionally used as the compressor interior environment improvement agent 32 for neutralizing acid.

Figure 5:
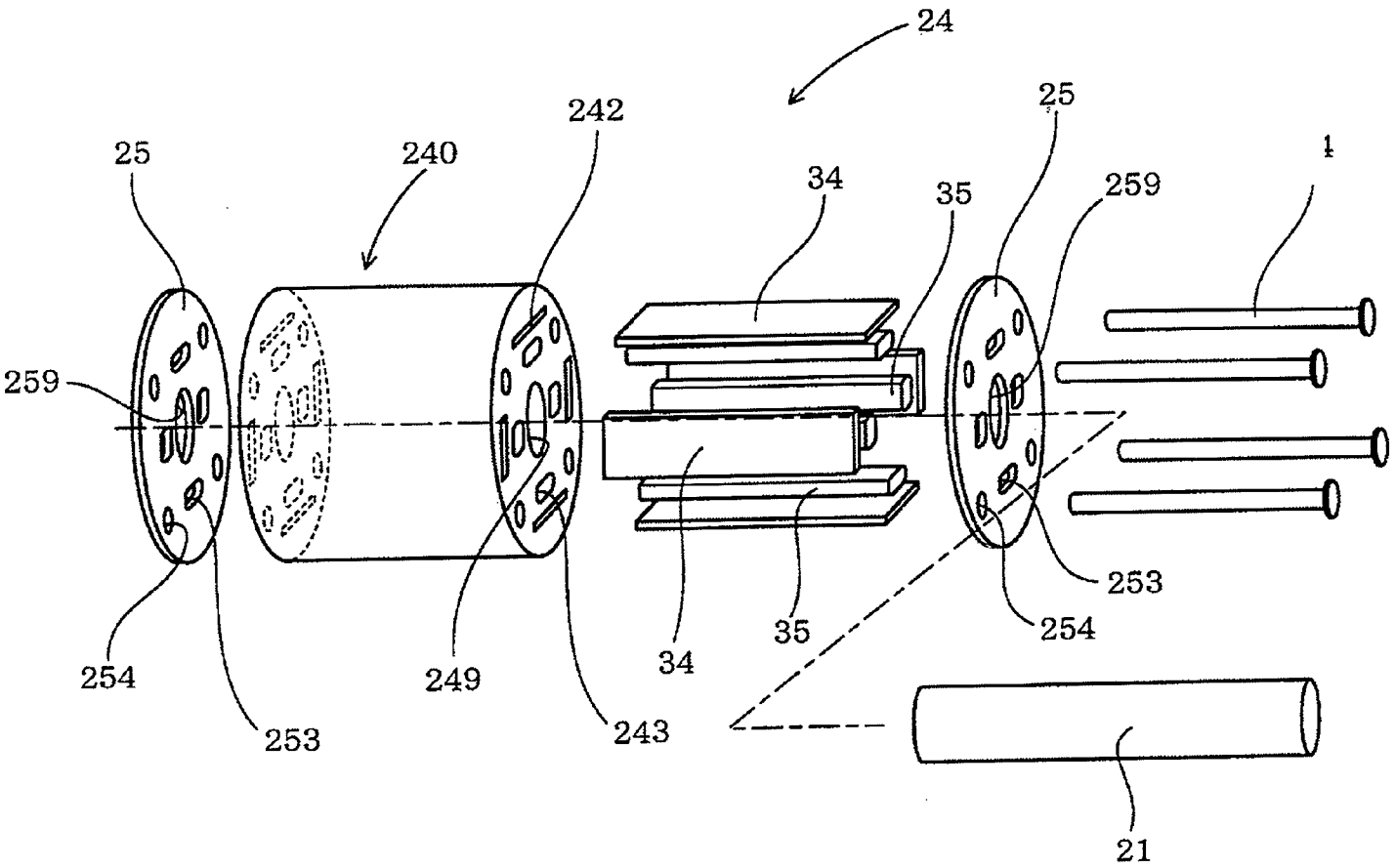
FIG. 5 is an exploded view showing a rotor of an electric motor of a motor-driven compressor according to a second preferred embodiment of the present invention.
Figure 7:
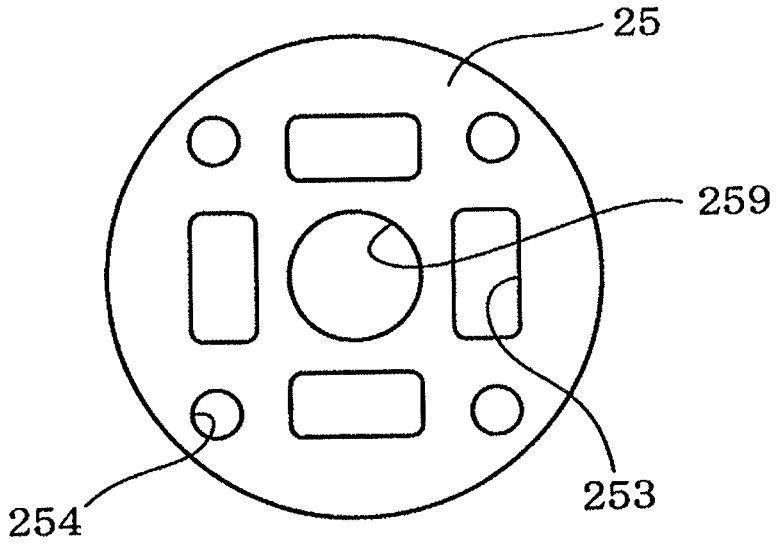
FIG. 7 is a schematic sectional view showing a shape of an end plate of the rotor of FIG. 5.
Figure 8:
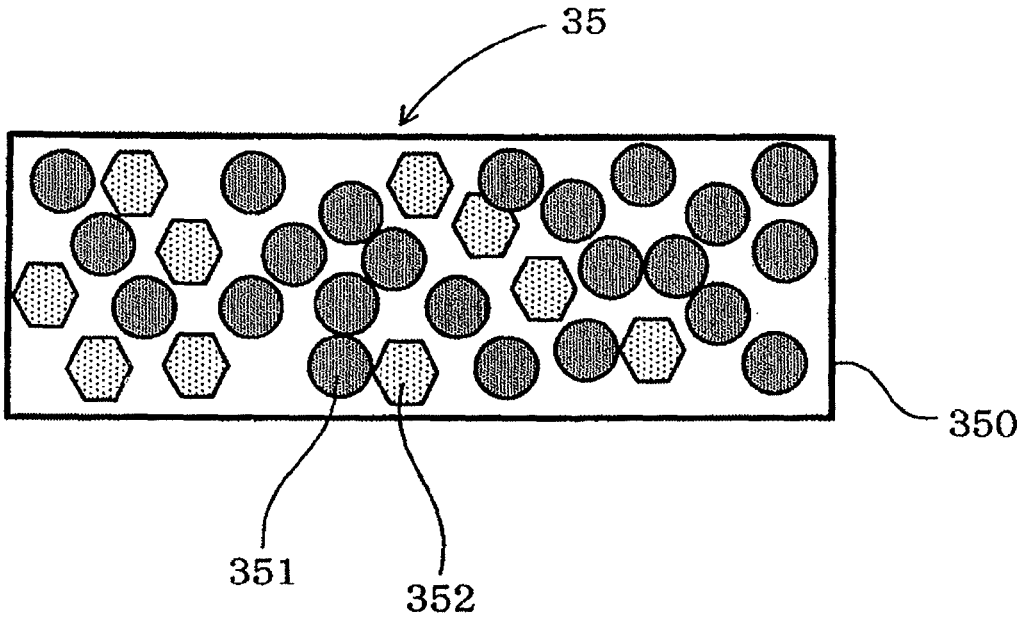
FIG. 8 is a schematic longitudinal sectional view showing an agent unit disposed in the rotor of FIG. 5.
Figure 9:
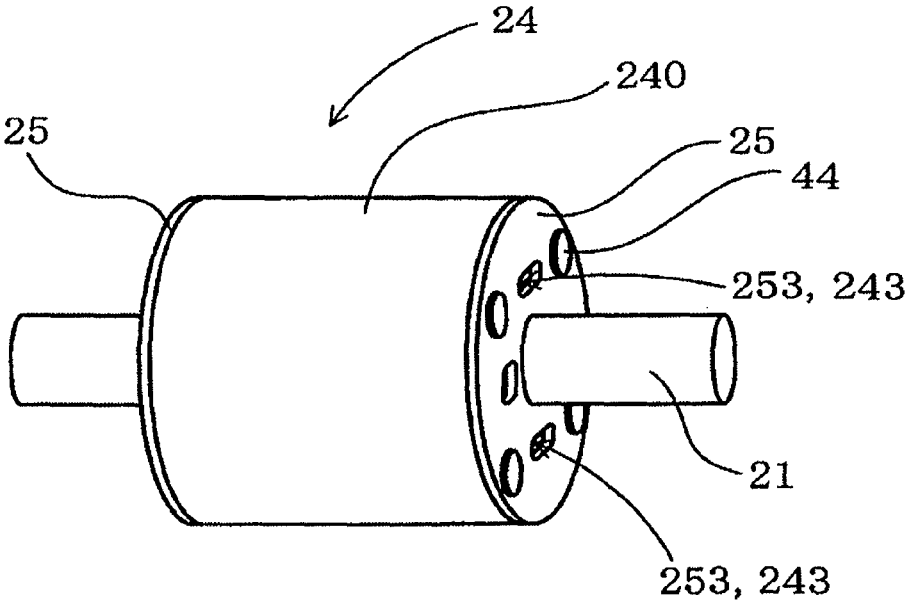
FIG. 9 is a perspective view showing the rotor of FIG. 5.

The following will describe a motor-driven compressor according to a second preferred embodiment of the present invention with reference to FIGS. 5 through 9. The second preferred embodiment differs from the first preferred embodiment in that a rotor of a modified structure is used. Referring to FIGS. 5 and 9, the rotor 24 is disposed on the inner peripheral side of the stator 23 as in the case of the first preferred embodiment of the present invention, as shown in FIGS. 1, 2. The rotor 24 has magnet holes 242 formed to extend therethrough along the axial direction thereof, and includes a rotor core 240 having agent holes 243 formed therethrough and a pair of end plates 25 disposed on the opposite ends of the rotor core 240.

Figure 6:
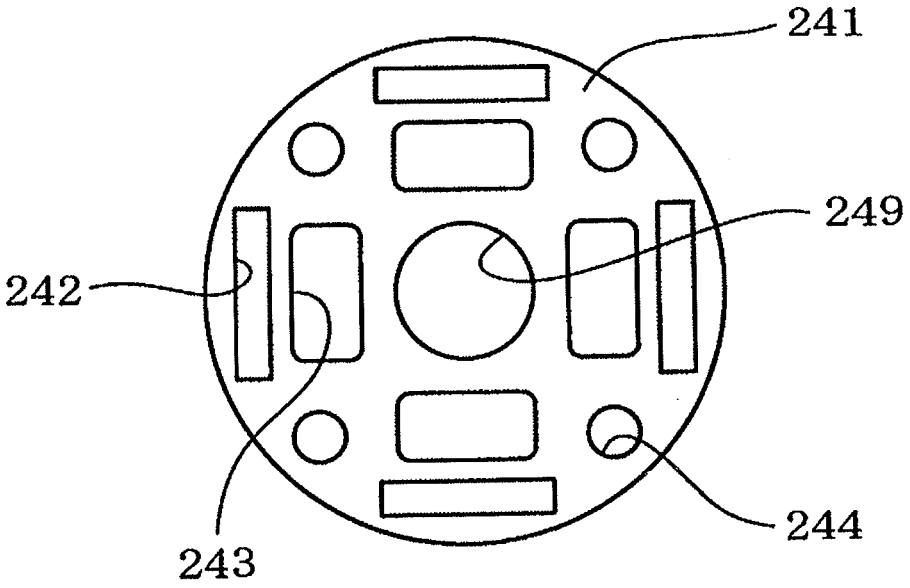
FIG. 6 is a schematic sectional view showing a shape of a rotor core sheet of the rotor of FIG. 5.

Referring to FIG. 6, the rotor core 240 is formed of a plurality of laminated rotor core sheets 241 each made of a disc-shaped electromagnetic steel plate. As shown in FIG. 6, each rotor core sheet 241 has a center hole 249 formed axially therethrough and through which the rotary shaft 21 is inserted, and four rectangular magnet holes 242 formed along the periphery of the rotor core sheet 241 at regular spaced intervals. The magnet holes 242 are arranged in a square arrangement as seen in the axial direction of the rotor 24, as shown in FIG. 6.

The rotor core sheet 241 also has four rectangular agent holes 243 formed axially and along the periphery of the rotor core sheet 241 at regular spaced intervals between the respective magnet holes 242 and the center hole 249. circular rivet hole 244 is formed between any two adjacent magnet holes 242. The rotor core 240 is formed of a plurality of the rotor core sheets 241 laminated together such that the holes 242, 243, 244 of the respective rotor core sheets 241 corresponds to the corresponding holes of the adjacent rotor core sheets 241.

As shown in FIG. 5, each permanent magnet 34 accommodated in the magnet hole 242 of the rotor core 240 has a plate shape. The four permanent magnets 34 are disposed in a square arrangement in the rotor 24 as seen in the axial direction of the rotor 24, as shown in FIG. 5, as in the case of the disposition of the magnet holes 242 thereof.

As shown in FIG. 5, an agent unit 35 including a case 350 filled with absorbent and neutralizer as a compressor interior environment improvement agent is inserted in the agent hole 243 of the rotor core 240. As shown in FIG. 8, the case 350 of the agent unit 35 has a plurality ports (not shown) formed through the opposite ends thereof and is filled with granular absorbents 351 and neutralizers 352. The absorbent 351 is made of zeolite having an average grain diameter between 0.5 and 10 mm, and the neutralizer 352 is made of calcium hydroxide having an average grain diameter between 0.5 and 10 mm.

As shown in FIGS. 5, 7, each of the end plates 25 which are mounted to the opposite ends of the rotor core 240 has a center hole 259 for receiving therethrough the rotary shaft 21 and four fluid holes 253 formed so as to correspond to the respective corresponding agent holes 243 of the rotor core 240. Each end plate 25 has four rivet holes 254 formed so as to correspond to the respective rivet holes 244 of the rotor core 240. The end plate 25 has no holes corresponding to the magnet holes 242, so that the opposite ends of the magnet hole 242 are closed by a pair of the end plates 25.

As shown in FIGS. 5 and 9, with the permanent magnets 34 and the agent units 35 inserted in the magnet holes 242 and the agent holes 243 of the rotor core 240, respectively, and the opposite ends of the rotor core 240 closed by the end plates 25, the rotary shaft 21 is inserted through the center holes 259, 249 of the end plates 25 and the rotor core 240, and the rivets 44 are inserted in the rivet holes 254, 244. The rotor core 240 and the end plates 25 are fastened together fixing with the rivets. The rotor 24 is installed in the motor-driven compressor as in the case of the first preferred embodiment of the present invention.

According to the second preferred embodiment of the present invention, the rotor 24 includes the rotor core 240 and a pair of the end plates 25 between which the rotor core 240 is interposed. The end plates 25 close the opposite ends of the magnet hole 242, so that circulating refrigerant and lubricating oil are prevented from flowing directly into the magnet hole 242. This reduces the fear of contact between the permanent magnet 34 and the moisture or acid contained in the circulating refrigerant and lubricating oil.

The fluid holes 253 formed in the end plate 25 of the rotor core 240 allow the circulating refrigerant and lubricating oil to be positively introduced through the fluid holes 253 into the agent holes 243. Rotating the rotor 24 enhances the chance of contact between the compressor interior environment improvement agent and the fluid such as refrigerant flowing through the fluid hole 253 into the agent hole 243. Thus, moisture or acid in the rotor 24 is removed or neutralized early by the compressor interior environmental improvement agent disposed in the agent hole 243, so that the circulating refrigerant and lubricating oil entering into the magnet hole 242 exists without chemical reaction with the permanent magnet 34. Therefore, the motor-driven compressor 1 may prevent the characteristics degradation of the permanent magnet 34 by itself.

Figure 10:
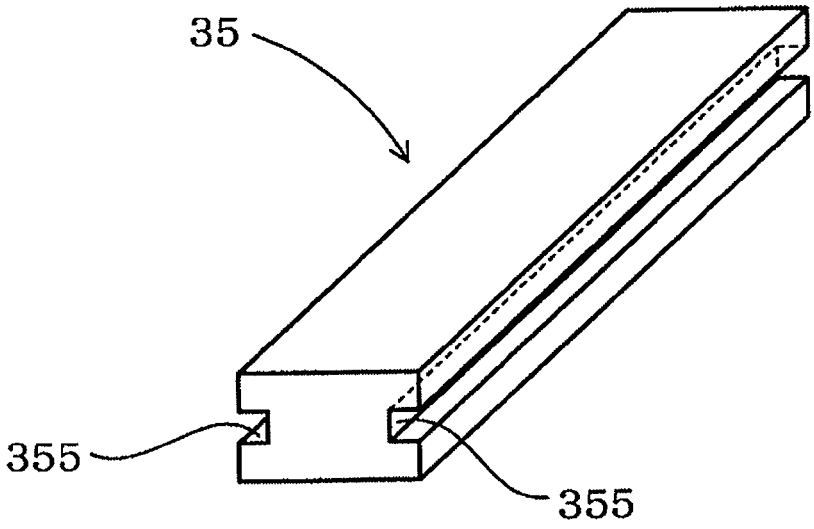
FIG. 10 is a perspective view showing an agent unit disposed in a rotor of a motor-driven compressor according to a third preferred embodiment of the present invention.
Figure 11:
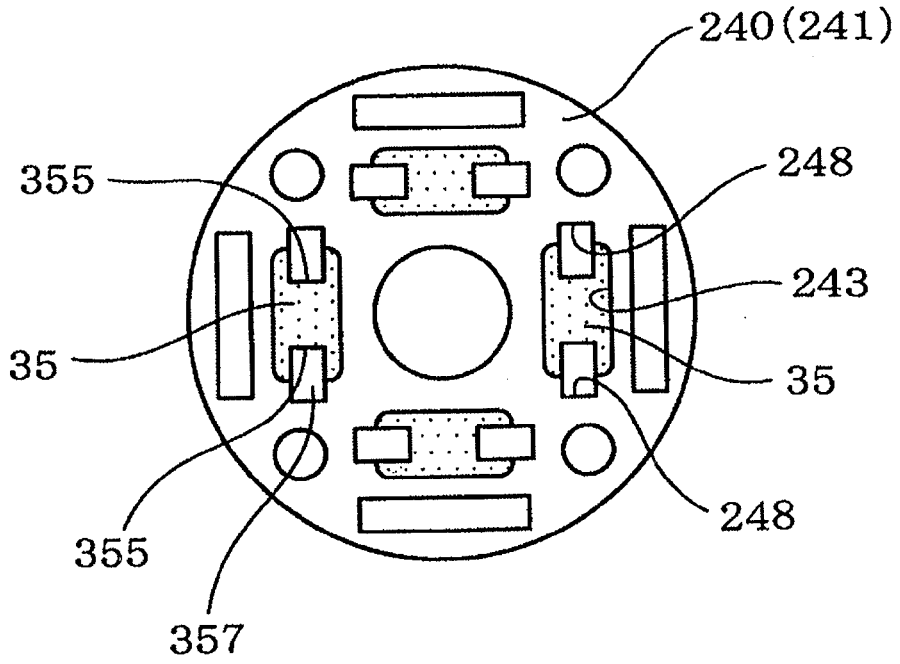
FIG. 11 is a schematic sectional view showing the rotor wherein the agent unit of FIG. 10 is inserted in a rotor core of the rotor of the electric motor of the motor-driven compressor according to the third preferred embodiment of the present invention.

The following will describe a motor-driven compressor according to a third preferred embodiment of the present invention with reference to FIGS. 10 and 11. The third preferred embodiment differs from the second preferred embodiment in the shapes of the agent hole 243 of the rotor core 240, the fluid hole 253 of the end plate 25 and the agent unit 35. As shown in FIG. 10, the agent unit 35 of the third embodiment has a shape of a rectangular bar with longitudinal grooves 355 formed in the opposite side surfaces of the bar. As shown in FIG. 11, the agent hole 243 of the rotor core 240 (made of rotor core sheets 241) has a shape having grooves 248 formed in opposite faces of the agent hole 243 and extending longitudinally so that the grooves 248 faces the grooves 355 when the agent unit 35 is inserted in the agent hole 243. Though not shown in the drawings, the fluid hole 253 of the end plate 25 of the rotor core 240 according to the third embodiment has a shape which is substantially the same as that of the agent hole 243 having the groove 248. Thus, a pair of spaces 357 is formed extending axially in the agent hole 243 of the rotor core 240 adjacent to the agent unit 35 or in the agent unit 35 adjacent to the agent hole 243 of the rotor core 240.

According to the third preferred embodiment of the present invention, as shown in FIG. 11, fluid passages are formed by the above spaces 357, thereby further enhancing the chance of contact between the agent unit 35 and the refrigerant and lubricating oil. Thus, according to the third embodiment, the effect of absorbing moisture or the effect of neutralizing acid may be improved. Further advantageous effects of the third preferred embodiment are the same as those of the second preferred embodiment.

Figure 12:
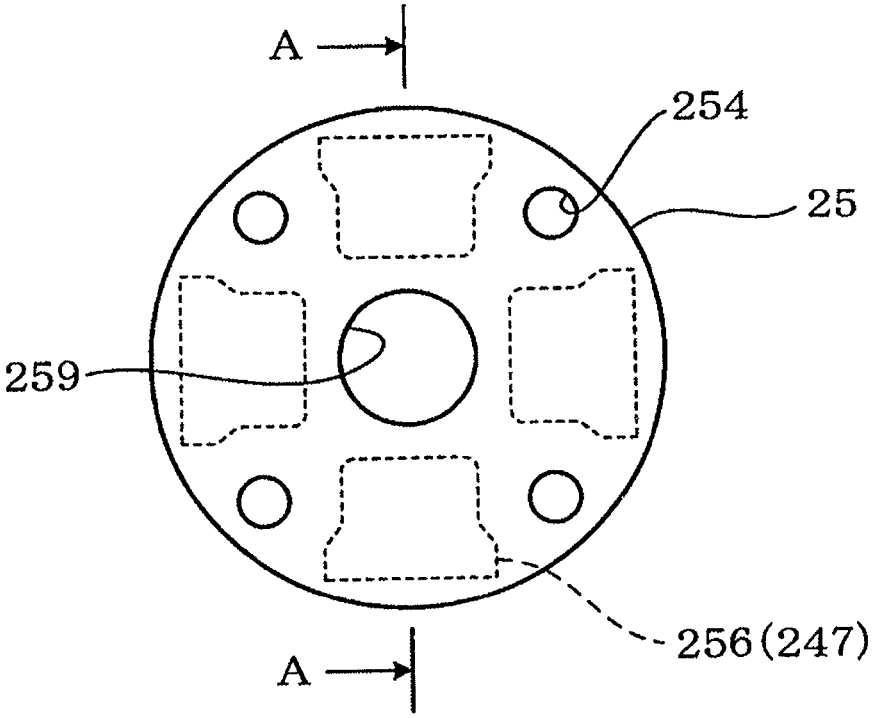
FIG. 12 is a schematic view showing a shape of an end plate of a rotor of a electric motor of a motor-driven compressor according to a fourth preferred embodiment of the present invention.
Figure 13:
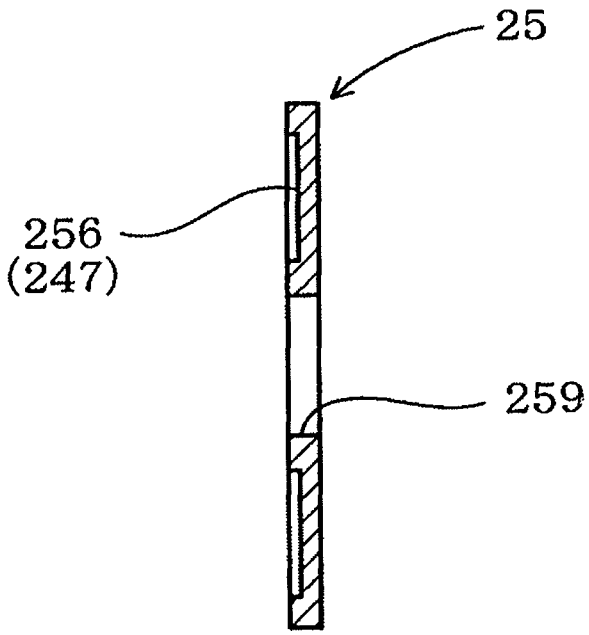
FIG. 13 is a schematic cross-sectional view of the end plate of FIG. 12 taken along the line A-A of FIG. 12.
Figure 14:
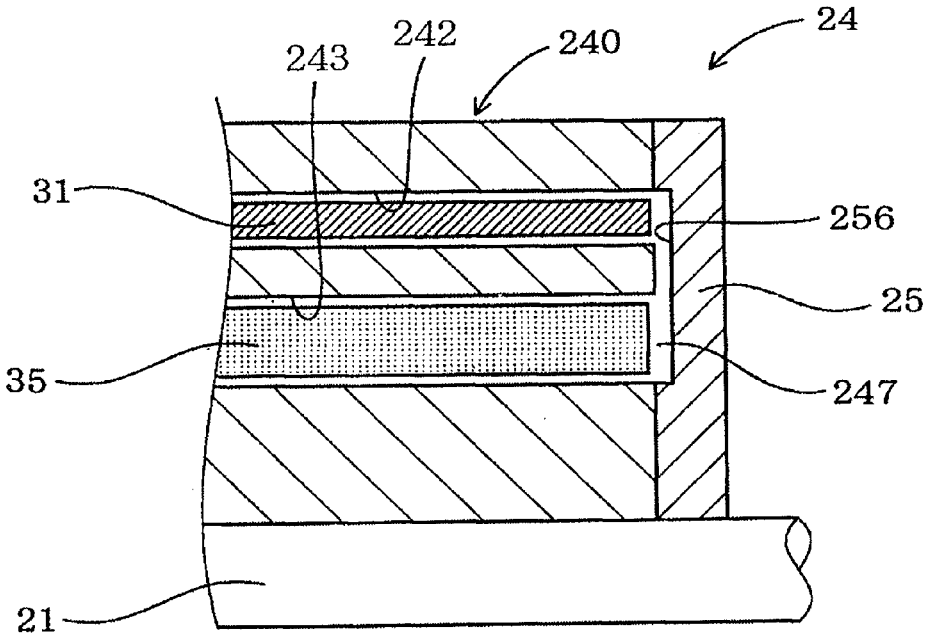
FIG. 14 is a fragmentary view showing a communication passage formed in a rotor core of the rotor of the electric motor of the motor-driven compressor according to the fourth preferred embodiment of the present invention.

The following will describe a motor-driven compressor according to a fourth preferred embodiment of the present invention with reference to FIGS. 12 through 14. The fourth preferred embodiment differs from the second preferred embodiment only in the shape of the end plate 25. As shown in the drawings, the end plate 25 of the rotor core 140 of the fourth preferred embodiment dispenses with the fluid holes such as 253 of the second preferred embodiment, but has recesses 256 formed in the inner surface thereof at positions that faces the magnet holes 242 and the agent holes 243 of the rotor core 240. As shown in FIG. 14, the end plates 25 close the opposite ends of the magnet holes 242 and agent holes 243 so as to seal the opposite ends of the magnet holes 242 and agent holes 243. As shown in FIG. 14, the recess 256 forms a communication passage 247 for providing fluid communication between the magnet hole 242 and its adjacent agent hole 243.

According to the fourth preferred embodiment of the present invention, refrigerant is prevented from entering into the agent holes 243 and the magnet holes 242, and any moisture or acid contained in the refrigerant entering into the agent holes 243 and the magnet holes 242 is absorbed or neutralized early by the compressor environment improvement agent. Moisture or acid entering into the magnet hole 242 is introduced into the agent hole 243 through the communication passage 247, so that the moisture or acid in the magnet hole 242 is prevented from staying therein, with the result that characteristic degradation of the permanent magnet 34 may be delayed.

Figure 15:
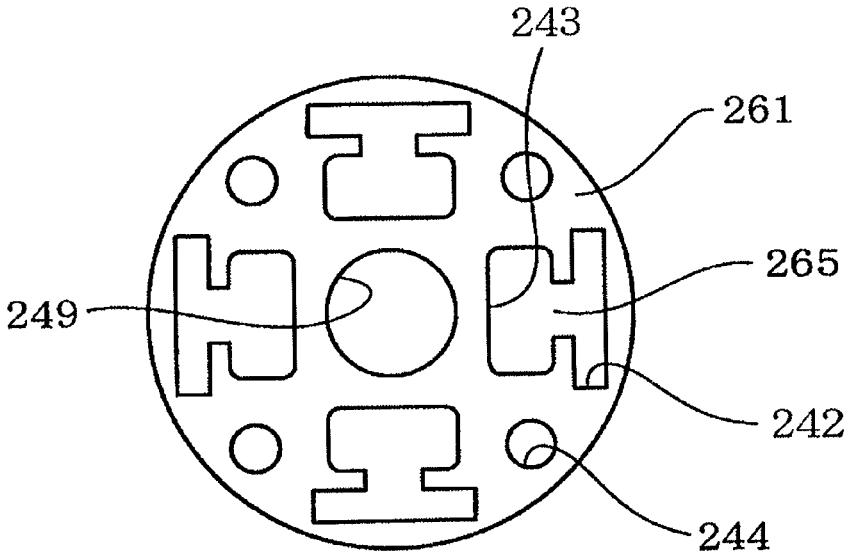
FIG. 15 is a schematic cross-sectional view of a rotor core sheet of a rotor of an electric motor of a motor-driven compressor according to a fifth preferred embodiment of the present invention.
Figure 16:
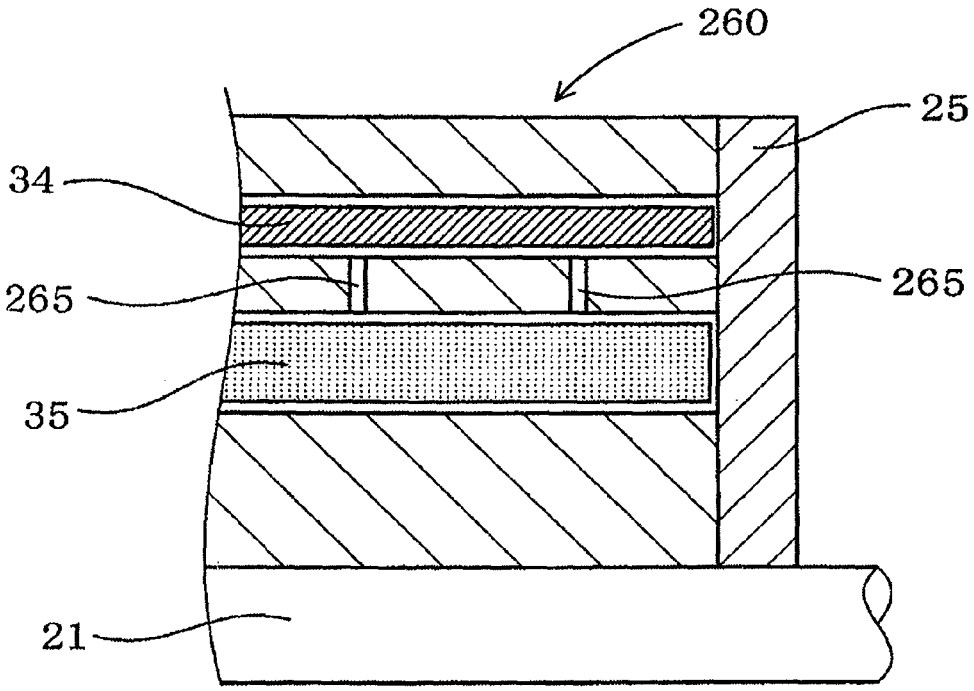
FIG. 16 is a fragmentary view showing a communication passage formed in a rotor core of the rotor of FIG. 15.

The following will describe a motor-driven compressor according to a fifth preferred embodiment of the present invention with reference to FIGS. 15 and 16. The fifth preferred embodiment differs from the second preferred embodiment in the shape of the end plate 25 and also in that the rotor core sheets 241 of the rotor core 240 includes some core sheets each having formed with an additional cut. One such rotor core sheet 261 having a cut is shown in FIG. 15. More specifically, the rotor core sheets 261 have a cut (communication passage) 265 formed therein for communication between the magnet hole 242 and the agent hole 243. The rotor core 260 (FIG. 16) of the fifth preferred embodiment of the present invention is formed of a plurality of rotor core sheets laminated in such a way that a rotor core sheet 261 having a communication passage 265 is interposed suitably between any two adjacent core sheets 241 having no communication passage 265.

As shown in FIG. 16, the rotor core 260 has a communication passage 265 formed therein for communication between the magnet hole 242 and the agent hole 243 by virtue of the presence of the rotor core sheets 261 in the rotor core 260. The end plate 25 of the fifth preferred embodiment is formed so as to close the agent hole 243 by dispensing with a fluid hole such as 253 of the second preferred embodiment.

According to the fifth preferred embodiment of the present invention, refrigerant is prevented from flowing into the agent holes 243 and the magnet holes 242 as much as possible, and any moisture or acid contained in the refrigerant and entering into the agent holes 243 and the magnet holes 242 is absorbed or neutralized early by the compressor interior environment improvement agent. Specifically, the moisture or acid entering into the magnet hole 242 may be introduced into the agent hole 243 through the communication passage 265. Thus, the moisture and acid in the magnet hole 242 are prevented from staying therein, so that the characteristics degradation of the permanent magnet 34 may be delayed.

Figure 17:
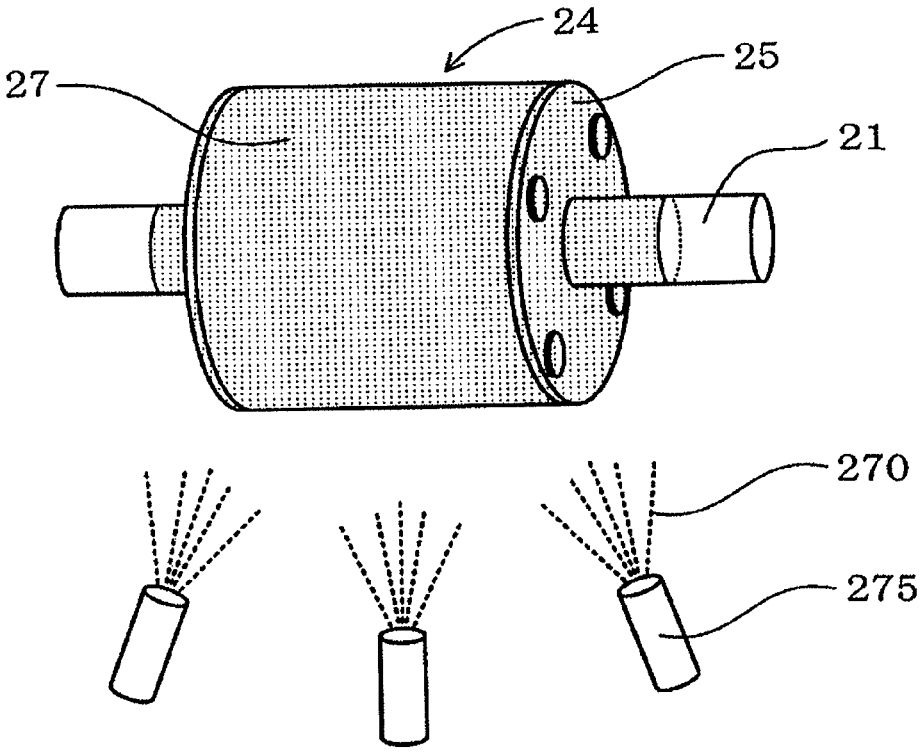
FIG. 17 is a an illustrative perspective view of a rotor of a electric motor of a motor-driven compressor according to a sixth preferred embodiment of the present invention, showing resin coating.

The following will describe a motor-driven compressor according to a sixth preferred embodiment of the present invention with reference to FIG. 17. The sixth preferred embodiment differs from the fourth and fifth preferred embodiments in the structure of the rotor 24. As shown in FIG. 17, the outer surface of the rotor 24 of the sixth preferred embodiment is covered with a resin coating 27. The resin coating 27 is formed by spraying a coating resin 270 with a spray nozzle 275. The resin coating 27 is made of fluorocarbon resin.

According to the sixth preferred embodiment of the present invention, moisture or acid is prevented by the resin coating 27 from entering into the magnet hole 242. Any moisture or acid which has entered into the magnet hole 242 is removed or neutralized by the compressor environmental improvement agent in the agent holes 243 that are in communication with the magnet holes 242 through the communication passage 247 or 265. Thus, the characteristic degradation of the permanent magnet may be delayed. In the sixth preferred embodiment of the present invention, the resin coating 27 is made of a fluorocarbon resin, but the resin coating 27 may be made of any other type of a resin material or a rubber material.

Figure 18:
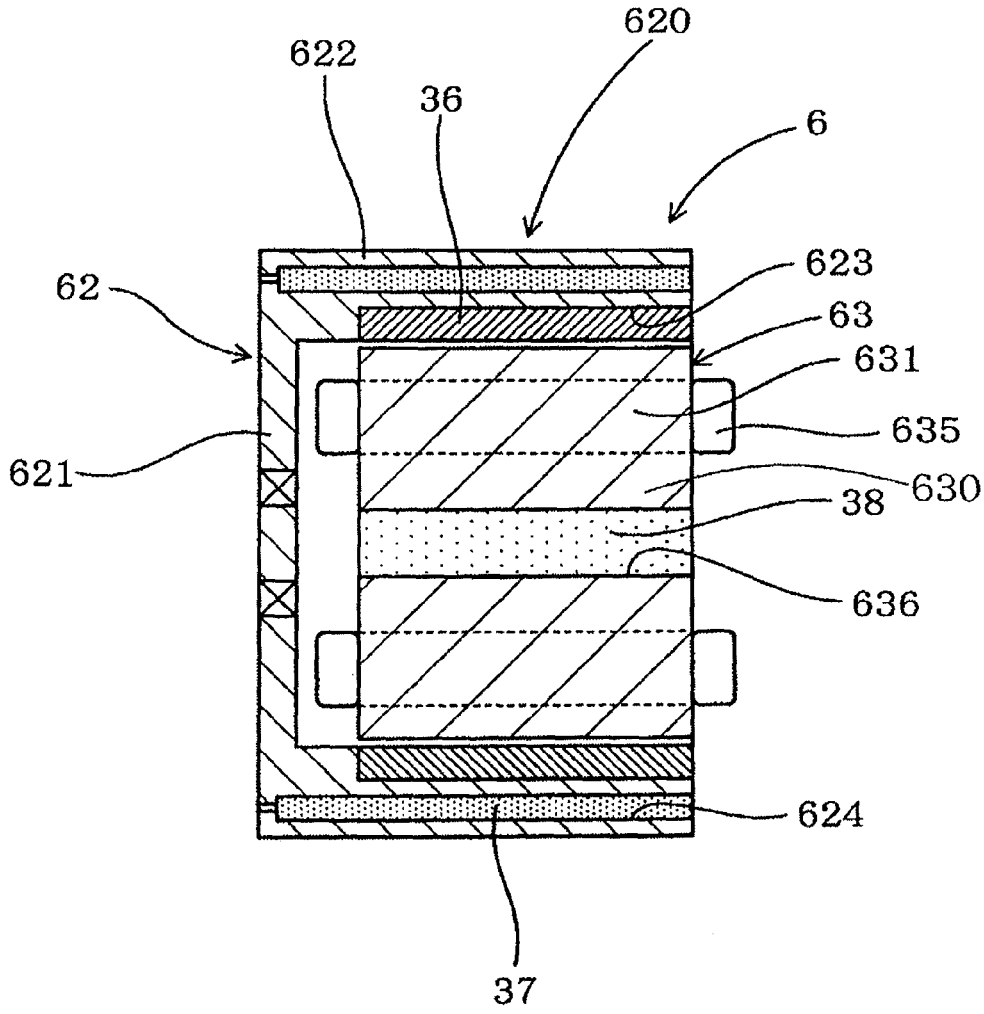
FIG. 18 is a longitudinal sectional view of an electric motor of a motor-driven compressor according to a seventh preferred embodiment of the present invention.
Figure 19:
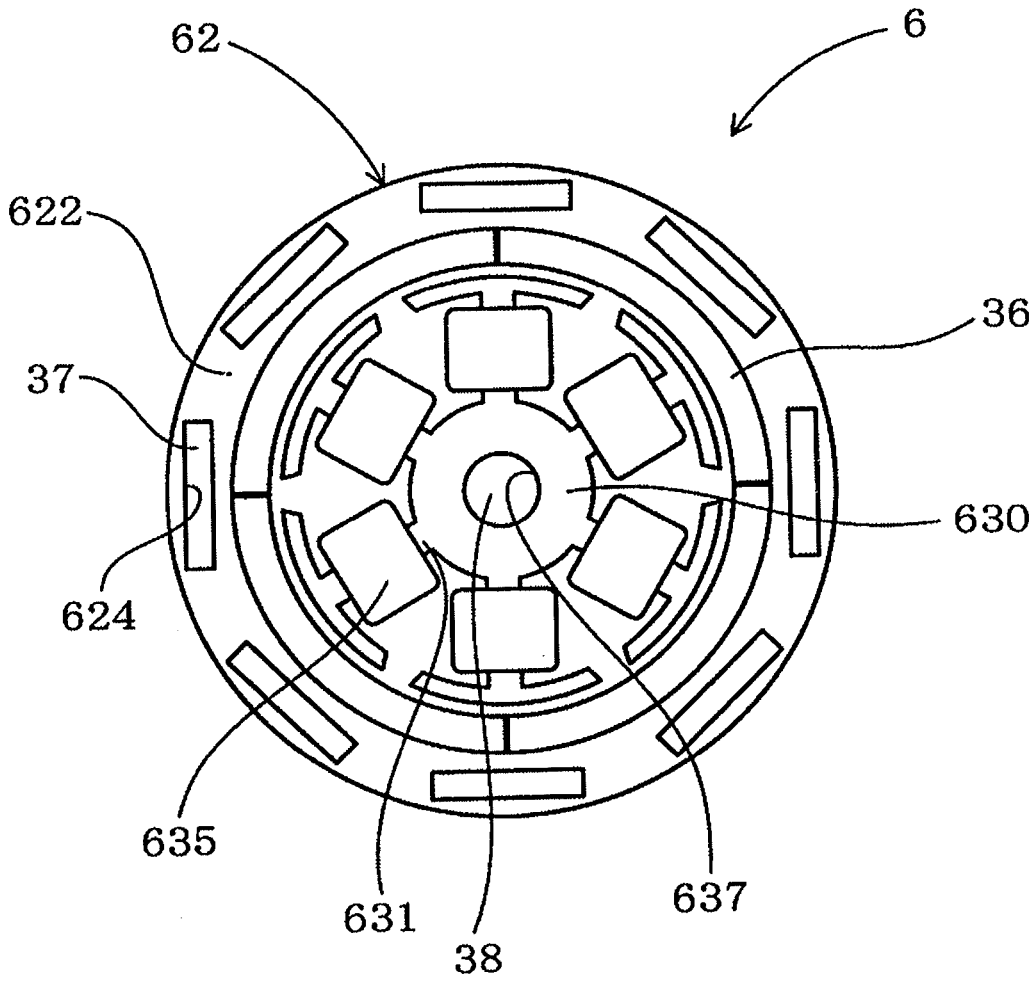
FIG. 19 is a schematic front view of the electric motor of FIG. 18.

The following will describe a motor-driven compressor according to a seventh preferred embodiment of the present invention with reference to FIGS. 18 and 19. The seventh preferred embodiment differs from the first preferred embodiment in the arrangement of the rotor and the stator of the electric motor 2. As shown in FIGS. 18 and 19, the electric motor 6 of the seventh preferred embodiment is configured such that the rotor 62 is disposed outside the stator 63.

As shown in FIGS. 18, 19, a rotor core 620 of the rotor 62 includes a disc-shaped bottom end 621 and a cylindrical portion 622 extending axially of the rotor core 620 from the outer periphery of the bottom end 621. The rotor core 620 has a recess formed in the inner peripheral surface of the cylindrical portion 622 thereof as the magnet hole 623, and four permanent magnets 36 are disposed in the magnet hole 623. Each permanent magnet 36 has a shape of a circular arc in the cross-section thereof. The four permanent magnets 36 are disposed in a circular arrangement in the magnet hole 623 of the rotor core 620 of the rotor 62 as seen in the axial direction of the rotor 62.

The rotor core 620 has eight agent holes 624 formed therein along the periphery of the rotor core 620 and radially outside the circular arrangement of the permanent magnets 36, as shown in FIG. 19. The agent unit 37 having a case filled with absorbent and neutralizer as the compressor internal environmental improvement agent is inserted in the agent hole 624. Though not shown in the drawings, the rotary shaft having the same structure as the first preferred embodiment is connected to the bottom end 621 of the rotor core 620 at the center thereof.

The stator 63 includes a bobbin member 630 having a plurality of radially extending coil cores 631 and coils 635 wound around the respective coil cores 631. The bobbin member 630 has a second agent hole 636 formed at the center thereof and receiving therein a second agent unit 38 having a case filled with both of absorbent and neutralizer as the compressor interior environment improvement agent. The bobbin member 630 is fixed to the housing of the motor-driven compressor (not shown). The rotor 62 disposed outside the coil 635 is rotated by energizing the coil 635.

The seventh preferred embodiment of the present invention makes it possible to dispose the compressor environment improvement agent adjacent to the permanent magnets 36 in an electric motor 6 having its rotor disposed radially outside the stator, so that the characteristic degradation of the permanent magnets 36 is prevented.

What is claimed is:

1. A motor-driven compressor comprising:

a housing including a suction port and a discharge port;

a rotary shaft;

a compression mechanism disposed in the housing, the compression mechanism compressing refrigerant flowed through the suction port into the compression mechanism and discharging the refrigerant through the discharge port; and an electric motor disposed in the housing, the electric motor driving the rotary shaft to rotate to drive the compression mechanism, the electric motor including:

a rotor fixedly mounted on the rotary shaft, the rotor includes a permanent magnet and a compressor interior environment improvement agent containing at least one of an absorbent for absorbing moisture and a neutralizer for neutralizing acid; and a stator fixed to the housing, wherein the rotor includes a magnet hole formed to extend through the rotor along the axial direction of the rotor, the permanent magnet is disposed in the magnet hole, the rotor includes an agent hole formed to extend through the rotor along the axial direction of the rotor, the compressor interior environment improvement agent is disposed in the agent hole, the rotor includes a rotor core including the magnet hole and the agent hole and a pair of end plates disposed on the opposite ends of the rotor core, each end plate closes the agent hole and the magnet hole so as to seal the agent hole and the magnet hole, and a communication passage is formed in the rotor core or the inner surface of the end plate for communication between the magnet hole and agent hole.

2. The motor-driven compressor according to claim 1, wherein the outer surface of the rotor is covered with a resin coating.

3. The motor-driven compressor according to claim 1, wherein the rotor is disposed inside the stator, the compressor interior environment improvement agent is positioned radially inside of the permanent magnet with respect to the rotary shaft.

4. The motor-driven compressor according to claim 1, wherein the absorbent is made of at least one of zeolite, activated carbon, alumina and silica gel.

5. The motor-driven compressor according to claim 1, wherein the neutralizer is made of at least one of calcium hydroxide, magnesium hydroxide, calcium carbonate and sodium carbonate.

6. The motor-driven compressor according to claim 1, wherein the motor-driven compressor is a vehicle air-conditioner including a circulation path made of a nonmetal tube.

7. The motor-driven compressor according to claim 1, wherein the motor-driven compressor is used in a refrigeration cycle in that refrigerant or mixed refrigerant circulates, the molecular formula of the refrigerant is $C_3H_mF_n$ in that "m" is an integer from one to five, "n" is an integer from one to five and an equation of "m+n=6" is satisfied and that has one double bond.

8. The motor-driven compressor according to claim 1, wherein the housing is filled with at least one of polyol ester, polyvinyl ether and polyalkylene glycol as lubricating oil.

9. A motor-driven compressor comprising:

a housing including a suction port and a discharge port;

a rotary shaft;

a compression mechanism disposed in the housing, the compression mechanism compressing refrigerant flowed through the suction port into the compression mechanism and discharging the refrigerant through the discharge port; and an electric motor disposed in the housing, the electric motor driving the rotary shaft to rotate to drive the compression mechanism, the electric motor including:

a rotor fixedly mounted on the rotary shaft, the rotor includes a permanent magnet and a compressor interior environment improvement agent containing at least one of an absorbent for absorbing moisture and a neutralizer for neutralizing acid; and a stator fixed to the housing, wherein the rotor includes a magnet hole formed to extend through the rotor along the axial direction of the rotor, the permanent magnet is disposed in the magnet hole, the rotor includes an agent hole formed to extend through the rotor along the axial direction of the rotor, the compressor interior environment improvement agent is disposed in the agent hole, the rotor includes a rotor core including the magnet hole and the agent hole and a pair of end plates disposed on the opposite ends of the rotor core, each end plate has a fluid hole for communication between the agent hole and the outside of the rotor core.

10. The motor-driven compressor according to claim 9, wherein the rotor is disposed inside the stator, the compressor interior environment improvement agent is positioned radially inside of the permanent magnet with respect to the rotary shaft.

11. The motor-driven compressor according to claim 9, wherein the absorbent is made of at least one of zeolite, activated carbon, alumina and silica gel.

12. The motor-driven compressor according to claim 9, wherein the neutralizer is made of at least one of calcium hydroxide, magnesium hydroxide, calcium carbonate and sodium carbonate.

13. The motor-driven compressor according to claim 9, wherein the motor-driven compressor is a vehicle air-conditioner including a circulation path made of a nonmetal tube.

14. The motor-driven compressor according to claim 9, wherein the motor-driven compressor is used in a refrigeration cycle in that refrigerant or mixed refrigerant circulates, the molecular formula of the refrigerant is $C_3H_mF_n$ in that "m" is an integer from one to five, "n" is an integer from one to five and an equation of "m+n=6" is satisfied and that has one double bond.

15. The motor-driven compressor according to claim 9, wherein the housing is filled with at least one of polyol ester, polyvinyl ether and polyalkylene glycol as lubricating oil.

16. The motor-driven compressor according to claim 9, wherein a fin is disposed in the fluid hole for introducing fluid into the agent hole when the rotor rotates.

17. The motor-driven compressor according to claim 9, wherein a space is formed extending axially in the agent hole adjacent to the compressor interior environment improvement agent.

18. The motor-driven compressor according to claim 9, wherein a space is formed extending axially in the compressor interior environment improvement agent adjacent to the agent hole.

* * * * *